US006977058B2

(12) United States Patent
Aubrey et al.

(10) Patent No.: US 6,977,058 B2
(45) Date of Patent: Dec. 20, 2005

(54) INOCULANT-STRAINER WITH IMPROVED FILTRATION EFFECTIVENESS AND INOCULANT DISSOLUTION

(75) Inventors: Leonard S. Aubrey, Arden, NC (US); Donald B. Craig, Fletcher, NC (US); Steven H. Martin, Hendersonville, NC (US)

(73) Assignee: Porvair PLC, Norfolk (GB)

( * ) Notice: Subject to any disclaimer, the term of this patent is extended or adjusted under 35 U.S.C. 154(b) by 133 days.

(21) Appl. No.: 10/385,813

(22) Filed: Mar. 11, 2003

(65) Prior Publication Data

US 2004/0178546 A1 Sep. 16, 2004

(51) Int. Cl.[7] ..... C21C 7/00
(52) U.S. Cl. ..... 266/229; 266/216; 75/316
(58) Field of Search ..... 266/216, 227, 266/229, 236; 75/305, 316, 407

(56) References Cited

U.S. PATENT DOCUMENTS

| | | | | |
|---|---|---|---|---|
| 3,881,937 A | | 5/1975 | Teufel | 75/130 R |
| 4,238,231 A | | 12/1980 | Dunks et al. | 75/130 R |
| 4,330,024 A | | 5/1982 | Wallace | 164/56.1 |
| 4,391,636 A | | 7/1983 | Windish | 75/130 R |
| 4,464,198 A | | 8/1984 | Mannion et al. | 75/130 R |
| 4,509,979 A | | 4/1985 | Bauer | 75/130 R |
| 4,511,401 A | | 4/1985 | Mannion et al. | 75/130 R |
| 4,517,019 A | | 5/1985 | Taniguchi | 75/130 R |
| 4,666,133 A | | 5/1987 | Fehr et al. | 266/216 |
| 5,028,036 A | * | 7/1991 | Sane et al. | 266/227 |
| 5,083,753 A | * | 1/1992 | Soofi | 266/229 |
| 5,690,161 A | | 11/1997 | Daussan et al. | 164/358 |
| 6,793,707 B2 | * | 9/2004 | Craig et al. | 266/216 |

* cited by examiner

*Primary Examiner*—Scott Kastler
(74) *Attorney, Agent, or Firm*—Joseph T. Guy; Nexsen Pruet, LLC

(57) ABSTRACT

A strainer for molten metal. The strainer comprises a well and a multiplicity of passages. Each passage comprises a first cavity a second cavity with a smaller equivalent diameter than the first cavity. A neck is between the first cavity and second cavity. An inoculation pellet is received in the well.

31 Claims, 5 Drawing Sheets

INOCULANT-STRAINER WITH IMPROVED FILTRATION EFFECTIVENESS AND INOCULANT DISSOLUTION

BACKGROUND OF THE INVENTION

The present invention relates to an improved strainer for filtering molten metal wherein the strainer comprises an inoculant pellet in operational association therewith. More specifically, the present invention relates to an improved strainer-inoculant combination providing improved straining and improved inoculation of molten iron passing there through.

Filtration of molten metal is a long practised art. Innoculation of the molten metal, particularly iron, is also a widely practiced art. It has been a long-standing desire to combine the filtration, or straining, of molten iron with inoculation.

Various treatment units have been presented in the art. Many of these utilize some form of flow restriction or redirection in an attempt to maximize contact between the molten metal and the inoculant. U.S. Pat. No. 4,511,401, for example, comprises a unit which is integral to the ladle. Molten metal is inoculated upon introduction into the ladle. While this technique is convenient, the inoculant tends to fade with time and the inoculation is therefore inefficient in such a device.

Converter chambers are described in the prior art wherein a separate inoculation chamber is employed. These typically include some form of flow restrictor, such as perforated walls or overflowing dams. Representative teachings of this type of device are provided in, U.S. Pat. Nos. 4,666,133; 4,509,979; 4,464,198; 4,391,636; 4,330,024 and 4,238,231.

These devices are deficient for several reasons. One reason is the problem associated with solid inoculant breaching the flow restrictor and being incorporated as an impurity in the, flowing molten metal. This typically occurs when the inoculant particle becomes sufficiently small to traverse the flow restrictor. These particles will then either continue to dissolve, be removed by subsequent straining or become an impurity in the solidified metal. Potential incorporation of solid inoculant in the flowing molten metal makes it difficult to determine the effectiveness of the inoculation. It is also difficult to insure that all of the metal is in sufficient contact with the inoculant to provide adequate inoculation.

Continued addition of an inoculant powder, as described in U.S. Pat. No. 4,517,019, overcomes some of the problems associated with flow restrictors. These devices are expensive to operate and the powder can agglomerate creating flow problems for the solid. The flow problems result in inconsistent powder delivery and inconsistent inoculation.

Formation of the inoculant into a filter is described in U.S. Pat. No. 5,690,161. The molten metal is caused to flow through the inoculant. As would be realized, the inoculants dissolve. As the inoculant dissolves the structure is weakened thereby leading to the possibility of breakage.

Combining an inoculant, typically in ingot form, with a filter or strainer is described in U.S. Pat. No. 3,881,937 and DE 4,318,309 A1. These represent improvements over the prior art yet they are still deficient for a number of reasons.

Incorporating an inoculant pellet into a cavity, as described in DE 4,318,309 A1 has several deficiencies. The inoculant tablet is not flush with the inlet face, or surface, of the strainer. The protruded pellet is typically a compressed powder which is highly susceptible to breakage. This creates a packaging problem requiring complex internal packing materials to protect the protruded pellet. The packaging problem is made worse by the lack of bonding between the strainer and pellet. Furthermore, the side peripheral surface of the inoculant tablet within the strainer body is not sufficiently exposed to the molten metal stream. This creates inefficient treatment. If the inoculant pellet is made flush the packaging problems decrease but the deficiencies with regard to dissolution are exasperated. Filters incorporating inoculant in a cavity have inferior inclusion removal.

Securing a pellet to the face of a filter with a protruding element, as described in U.S. Pat. No. 3,881,937 reduces the problems associated with insufficient surface area yet other problems are created. The packaging problems remain and are exasperated. Problems associated with inclusion removal efficiency remain. There is a further problem associated with the weakness of the protrusion. This weakness creates a continual packaging problem resulting in expensive packing or extensive losses during shipping.

The lack of a suitable system and method for treating molten metal has been a long felt need in the art. This need is met by the present invention.

BRIEF SUMMARY OF THE INVENTION

It is an object of the present invention to provide a straining system for molten metal which inoculates and strains the metal without the problems associated with the prior art.

It is another object of the present invention to provide a strainer for molten metal which secures an inoculation pellet without decreasing the dissolution of the pellet and that allows adequate contact between the molten metal and pellet to effect suitable and reproducible treatment.

It is another object of the present invention to provide a strainer with improved inclusion removal and the strainer is associated with an inoculant.

A particular feature is the absence of a protruding pellet and the packaging efficiencies provided thereby.

Another particular feature is the enhanced treatment achieved by the inventive system due, in part, to the improved contact between the metal and inoculant. The improved treatment is done in concert with improved inclusion removal.

A particular feature of the present invention is the advantage provided in a strainer comprising a well within which an inoculant pellet is contained wherein the molten metal can encompass and flow completely around the pellet without decreasing the straining effectiveness.

These and other advantages, as would be realised to one of ordinary skill in the art, are provided in a strainer for molten metal. The strainer comprises a well and a multiplicity of passages. Each passage comprises a first cavity a second cavity with a smaller equivalent diameter than the first cavity. A neck is between the first cavity and second cavity.

Another embodiment is provided in a treatment device for molten metal. The treatment devices comprising a strainer. The strainer comprises a well and a multiplicity of progressively stepped down passages. A pellet, comprising an inoculant for the molten metal, is received in the well.

Another embodiment is provided in a strainer for molten metal. The strainer comprises a multiplicity of passages and a well. The well comprises a floor; a multiplicity of well passages through the floor and a multiplicity of shelves on the floor. At least two lugs extend into the well.

DETAILED DESCRIPTION OF THE INVENTION

The inventors of the present application have developed, through diligent research, an improved strainer for use in straining and an improved method for treating molten metal with an inoculant. The inventors have also developed an improved method for straining molten metal which allows treatment at the filter while eliminating the problems associated with the prior art.

The invention will be described with reference to the figures forming a part of the present application. In the various figures similar elements are numbered accordingly.

Figure 1:
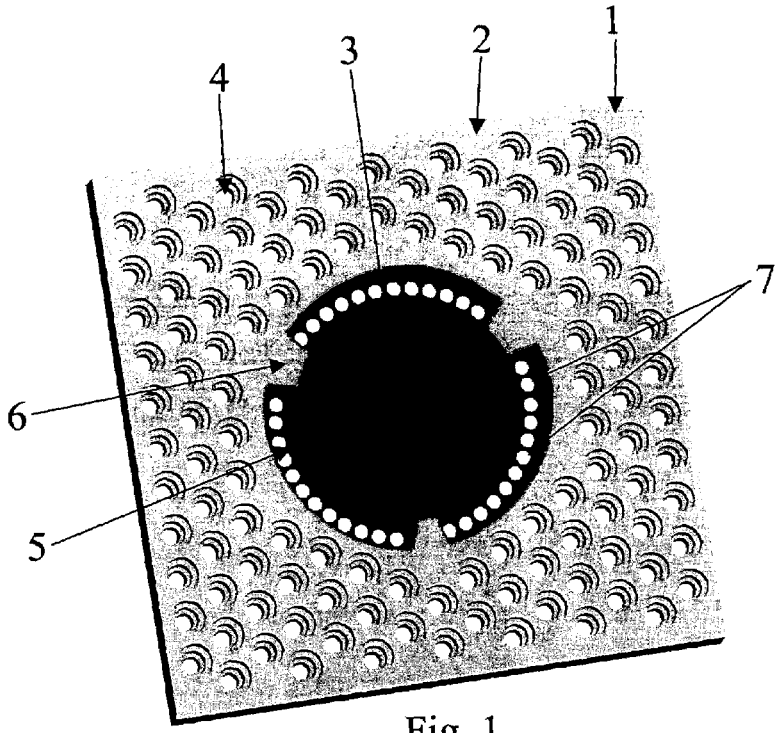
FIG. 1 is a top view of an inventive strainer with an inoculant pellet incorporated therewith.

A strainer assembly comprising an inoculation pellet is illustrated in top view in FIG. 1. and generally represented at 1. The strainer assembly comprises a strainer, 2, and pellet, 3. The strainer, 2, comprises a multiplicity of, preferably progressively stepped down, passages, 4. While not restricted to any theory, the stepped down passages are thought to induce turbulent flow in order to improve inclusion particle transport to the strainer wall thereby obtaining improved inclusion capture efficiency. A well, 5, preferably centrally located, receives the pellet, 3, therein. A multiplicity of lugs, 6, secures the pellet by friction fit within the well. The pellet can also be secured to the lugs by an adhesive. It is most preferred that the depth of the well be at least as deep as the tablet is thick to allow for efficient packing. Within the well, 5, are well passages, 7, allowing molten metal to flow between the tablet and well wall wherein the metal is strained in the well passages to be passed through the strainer assembly as treated strained molten metal.

Figure 2:
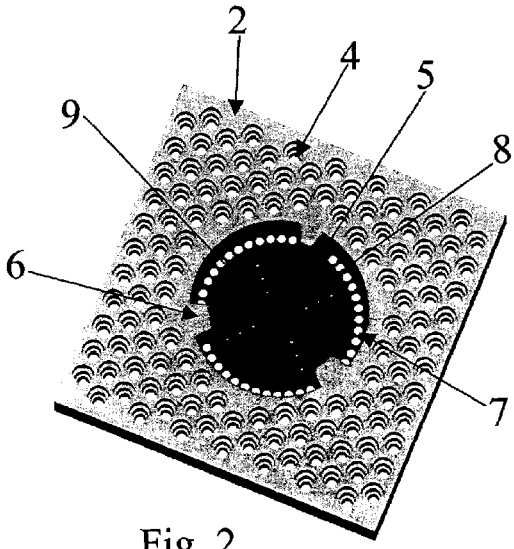
FIG. 2 is a perspective view of an embodiment of a strainer without a pellet.

A perspective view of a preferred strainer, without a pellet, is provided in FIG. 2. The strainer, 2, comprises a multiplicity of preferably progressively stepped down passages, 4, lugs, 6, and well passages, 7, as illustrated and described relative to FIG. 1. The well, 5, comprises a floor, 8, with depressions, 9, therein. The depressions, 9, provide increased surface area to enhance the ability of adhesive to adhere to the floor, 8, of the well, 5. Alternatively, the depressions may allow flow of molten metal under the pellet. This alternative embodiment may also be considered, as will be described further herein, to include protrusions or shelves upon which the pellet may rest to allow molten metal to flow between the pellet and floor thereby completely encompassing the pellet with molten metal to greatly improve inoculation efficiency.

Figure 3:
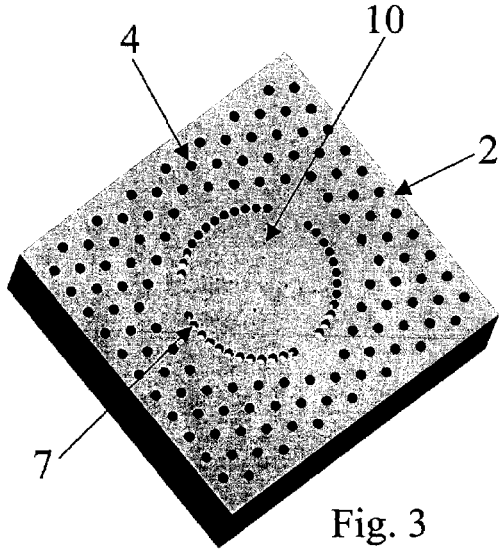
FIG. 3 is a bottom view of an embodiment of the present invention.

A bottom view of the preferred strainer of FIG. 2 is provided in FIG. 3. In FIG. 3, the exit end of the passages, 4, and well passages, 7, are illustrated. Optional, but preferred, glue holes, 10, within, or instead of, the depressions (FIG. 2), provide additional surface area for adhesive anchoring.

Figure 4:
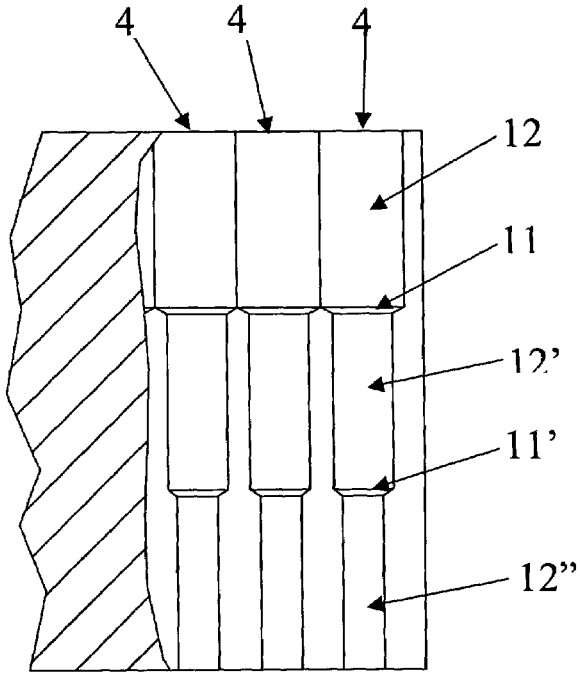
FIG. 4 is a cross-sectional view of a portion of a strainer or the present invention.

A partial cutaway of the strainer is provided in FIG. 4 wherein the details of the progressively stepped down passages, 4, is more clearly visible. The progressively stepped down passages, 4, comprise at least one neck, 11, between an upper, larger cavity and a lower smaller cavity. For example, in FIG. 4, with two step downs, the first neck, 11, is between the larger cavity 12 and smaller cavity 12'. Likewise, a second neck, 11', is between a larger cavity, 12', and a smaller cavity, 12". It is preferred to have at least two step-downs, and therefore at least one neck, with more being preferable.

Strainers are preferably at least 0.5 inches thick with at least 2 cavities. It is most preferable to have a strainer of no more than 3 inches thick with no more than about 20 step-downs. The difference in equivalent diameter from the larger cavity to the adjacent smaller cavity is preferably at least about 10%, more preferably at least about 20%. Most preferably the difference in equivalent diameter from the larger cavity to the adjacent smaller cavity is at least about 50%. It is most preferred that the difference in equivalent diameter from the larger cavity to the adjacent smaller cavity be no more than about 75%. Equivalent diameter is defined herein as the diameter of a circle having the same cross-sectional area as the cavity. A cylindrical cavity is most preferred due to manufacturing considerations but other shapes such as oblong, trigonal, square, polygonal, etc. are within the scope of the present invention.

The thickness of the neck, measured as the distance between the upper cavity and lower cavity, is determined by the angle of the neck relative to the upper cavity. It is preferable that the thickness of the neck be sufficiently large to form an angle, relative to the face of the larger cavity, of over 90° to insure that there are no eddies created in the flowing molten metal. It is more preferably that the neck be sufficiently large to form an angle, relative to the face of the larger cavity of no more than about 160°. Above about 160° the turbulence created in the flow is theorized to be insufficient to improve inclusion capture efficiency. An angle of about 110° to about 150° is preferred with about 135° being most preferred.

The depth of the cavity is preferably at least about 0.1 inches to no more than about 1 inch. More preferably the cavities are at least about 0.2 inches to no more than about 0.5 inches. A strainer comprising three 0.30 inch deep cavities with equivalent diameters of about 0.140 inches, about 0.105 inches and about 0.070 inches with each cavity being about 0.30 inches in depth and each neck thickness being about 0.01 inches is exemplary.

Figure 5:
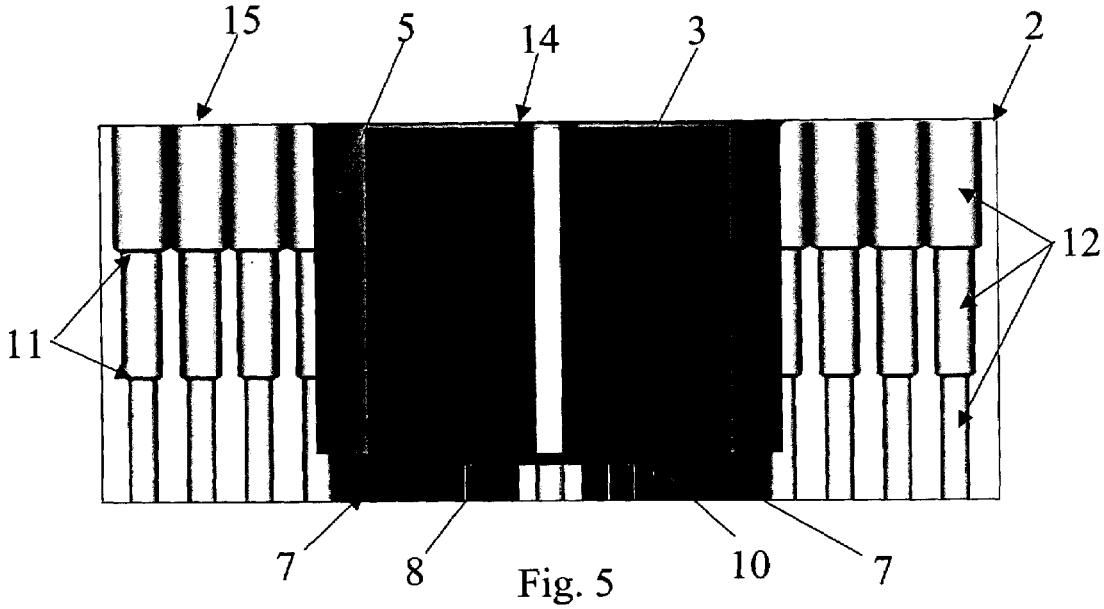
FIG. 5 is a partial cross-sectional view of a strainer of the present invention and pellet incorporated therein.

A cross-sectional view of a strainer assembly is provided in FIG. 5. In FIG. 5, the strainer, 2, is shown in cross-section. The pellet, 3, is shown as the preferred cylindrical shape received in the well, 5, of the strainer. The upper extent of the pellet, 14, is approximately flush with the entrance surface, 15, of the strainer. A flush pellet is preferred for packaging. The pellet is preferably in contact with the floor, 8, of the well, 5, thereby minimizing movement and allowing for adequate contact if an adhesive is used. Optional glue holes, 10, are provided for increased surface area if adhesive is used. Well passages, 7, promote flow around and past the pellet and improve dissolution of the pellet.

Figure 6:
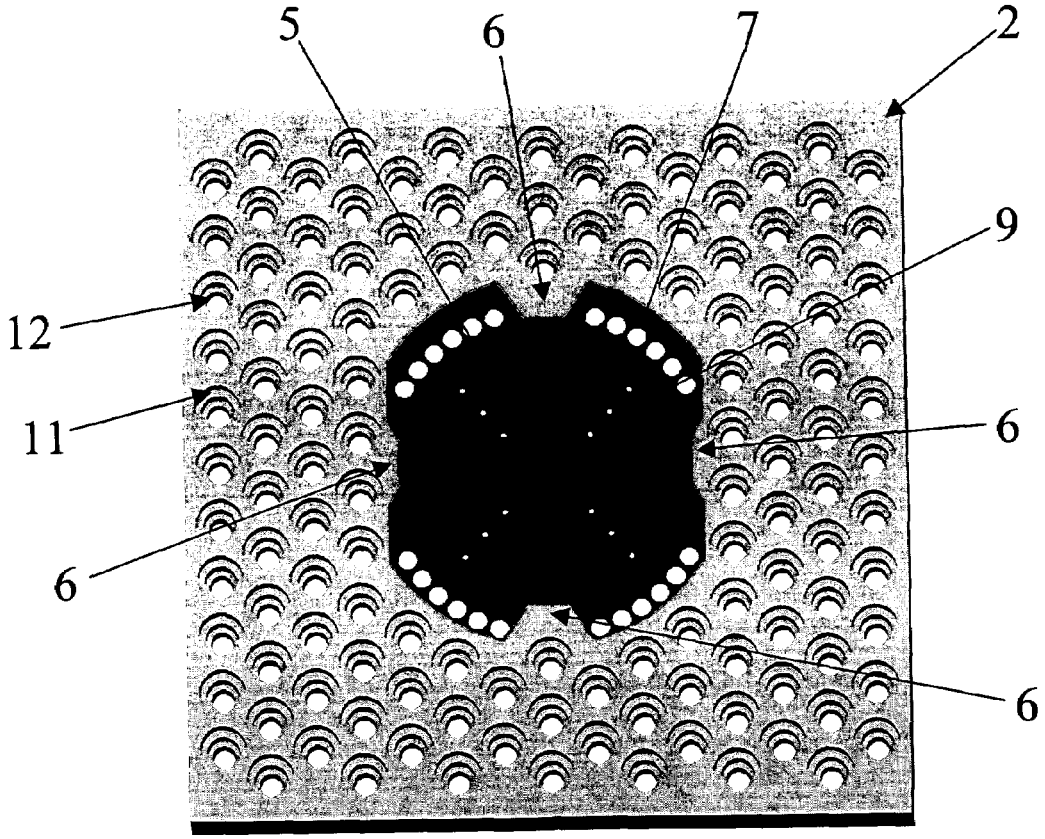
FIG. 6 is a perspective view of an embodiment of the present invention.

A preferred embodiment is illustrated in FIG. 6. In FIG. 6 the strainer, 2, comprises a multiplicity of passages, 4, wherein each passage preferably comprises an upper cavity, 12, and lower cavity separated by an angled neck, 11. The well, 5, comprises lugs, 6, for locating the pellet (not shown) within the well preferably by friction fit. The well comprises well passages, 7, to facilitate dissolution, and depressions, 9, to improve adhesion if adhesives are employed.

Figure 7:
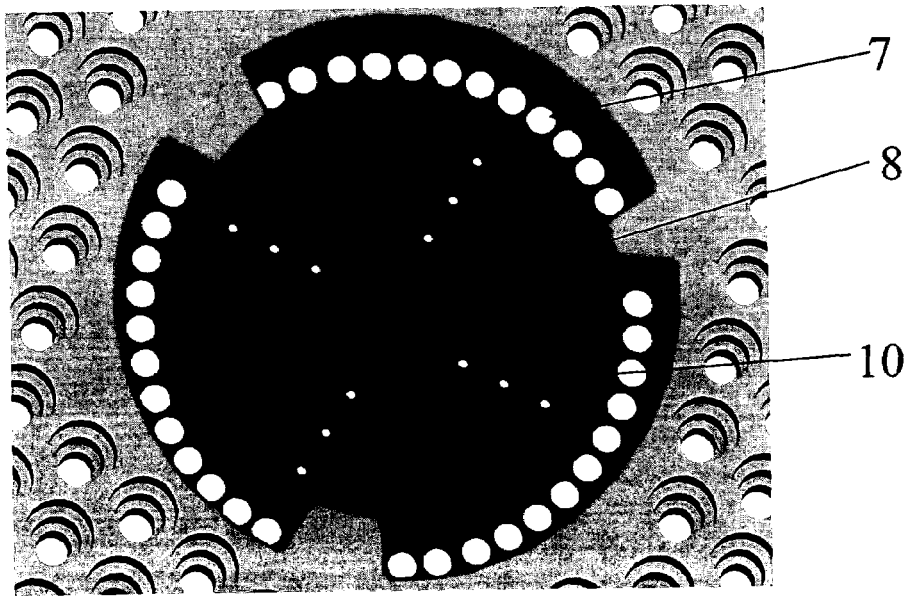
FIG. 7 is a close-up view of the well of the embodiment of FIG. 6.

A closer view of the well of FIG. 6 is provided in FIG. 7. In FIG. 7 the well comprises a multiplicity of well passages, 7. Depressions, 9, preferably in the form of concentric circles, are illustrated to further comprise glue holes, 10, therein. The glue holes provide additional surface area for adhesion but they also allow volatile gases to escape from the adhesive during the bonding operation.

Figure 8:
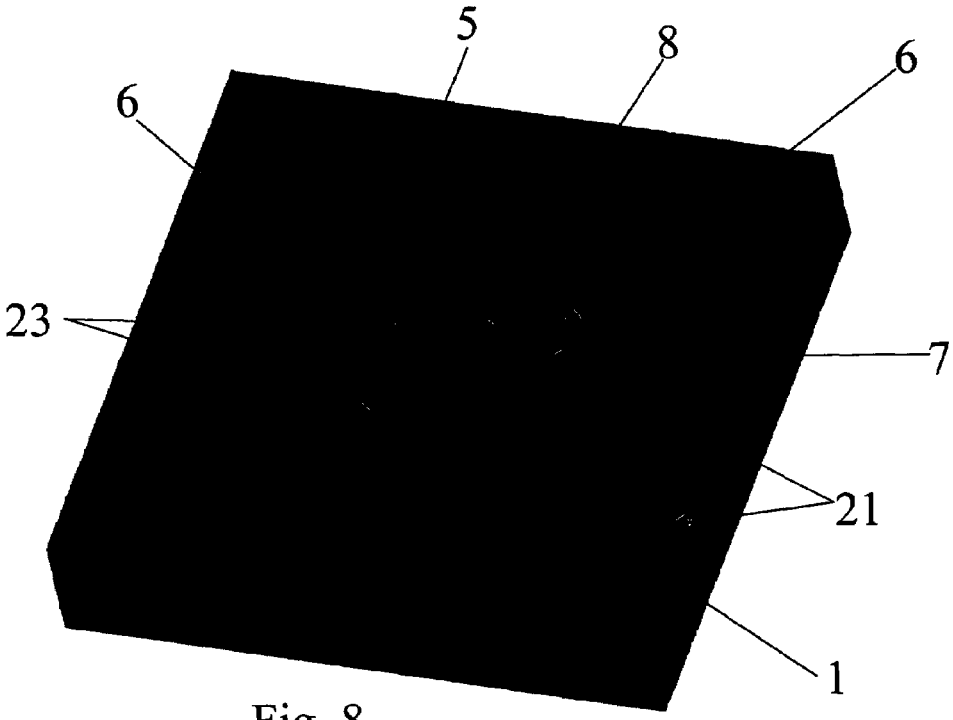
FIG. 8 is a top perspective view of an embodiment of the present invention.

Another embodiment will be described in reference to FIGS. 8–12. FIG. 8 is a top view of an embodiment. In FIG. 8, the strainer, 1, comprises a centrally located well, 5. The well comprises a floor, 8. The floor, 8, comprises a plurality of well passages, 7. Around the periphery of the well, 5, are lugs, 6. In one embodiment the lugs are fluted or rounded, as illustrated in FIGS. 8–12. The lugs could also be trapezoidal, as illustrated in FIGS. 1–7, pointed or other shapes consistent with the desire to maintain the pellet by friction fit or as a surface for applying adhesive between the pellet and lug. The floor, 8, of the well, 5, comprises a plurality of shelves, 23. The shelves separate the bottom surface of the pellet from the floor of the well. The shelves allow molten metal to flow around, and under, the pellet and then to pass through the well passages, 7, thereby maximizing the contact between molten metal and pellet surface. The passages, 21, and well passages, 7, may be stepped down, as described relative to FIGS. 1–7, or straight walled without departing from the present invention.

The pellet can be secured by friction fit between the lugs or by an adhesive. The adhesive may be between the lugs and pellet, between the well floor and pellet, between the shelves and pellet or a combination thereof. The pellet may also be friction fit between the lugs and secured by adhesive to the well floor and/or shelves.

Figure 9:
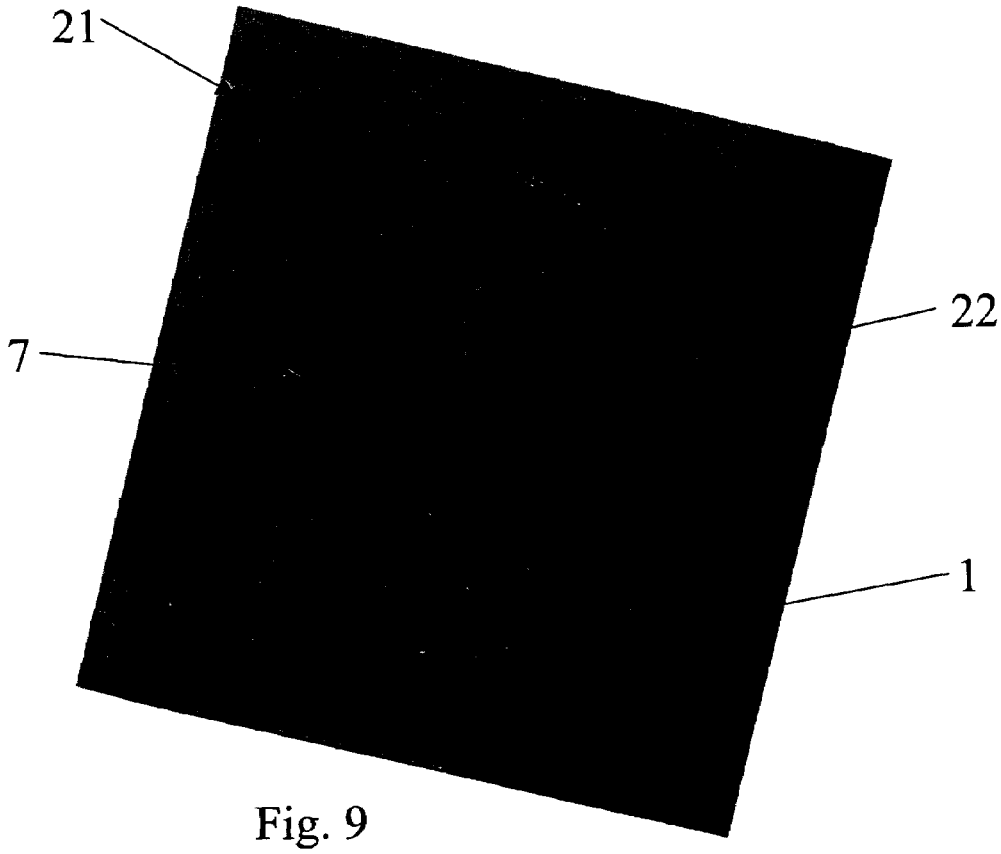
FIG. 9 is a bottom perspective view of the embodiment of FIG. 8.

A perspective bottom view of the embodiment of FIG. 8 is shown in FIG. 9. The bottom of the strainer comprises a neck, 22, protruding from the bottom surface for reasons that will be clear from further discussions herein.

Figure 11:
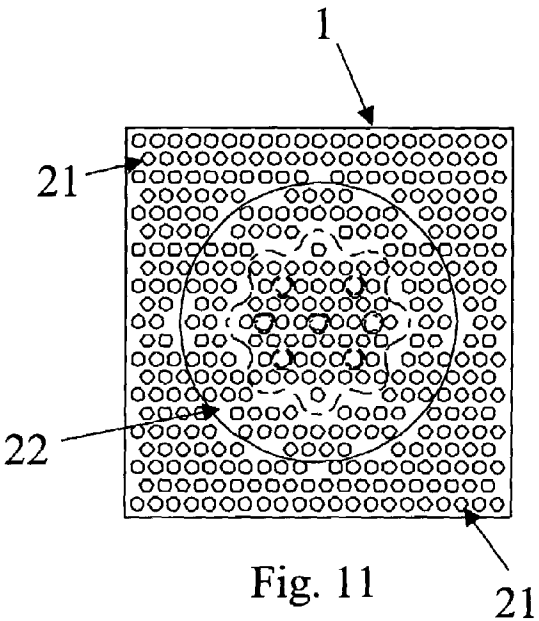
FIG. 11 is a bottom view of the embodiment of FIG. 8.
Figure 10:
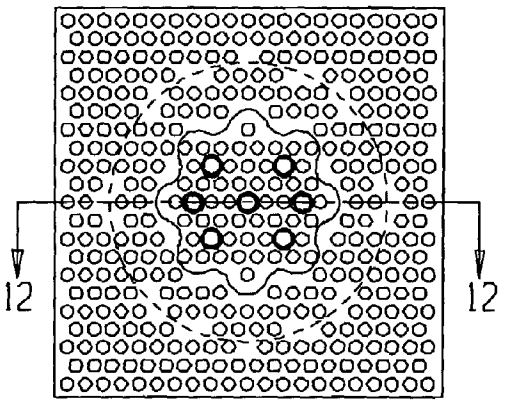
FIG. 10 is a top view of an embodiment of the embodiment of FIG. 8.
Figure 12:
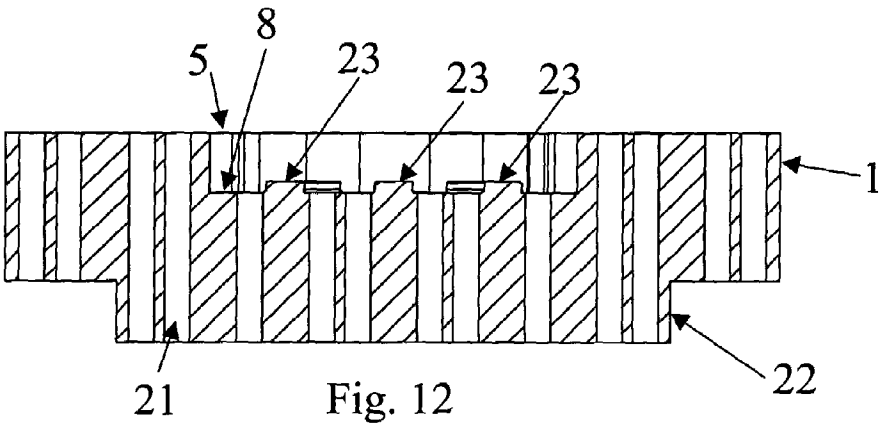
FIG. 12 is a cross-sectional, view taken along line 12—12 of FIG. 10.

FIG. 10 is a top view of the embodiment of FIG. 8. FIG. 11 is a bottom view of the embodiment of FIG. 8. Similar elements are numbered accordingly. A cross-sectional view taken along line 12—12 of FIG. 10 is provided as FIG. 12. In FIG. 12, similar elements are numbered accordingly. The neck, 22, approximately corresponding to the well, 5, is shown to protrude beyond the bottom of the outer extent of the strainer. As can be realized from FIG. 12, the thickness from the floor, 8, of the well, 5, to the bottom of the neck, 22, is approximately the same thickness as that of the remaining body of the strainer. This insures that the thickness of the strainer is approximately constant at all points thereby greatly increasing the strength. Furthermore, by insuring an approximately constant thickness throughout the strainer expansion and contraction due to heating and cooling is approximately the same. This constant thickness decreases the occurrence of cracking that could occur with differing thickness. The variation in thickness due to the shelves is not typically sufficient to cause cracking and is of minor concern.

The inoculant pellet is preferably a cylindrical pellet comprising elements known to dissolve and treat molten metal. The treatment may be for nodulization, carbide elimination, etc. Control of the dissolution rate of the pellet is important to insure the proper treatment is acheived.

Controlling the dissolution rate to allow for a wide range of flow rates, or approach velocities, allows for predictable inoculation at the strainer without regard for approach velocities within a working range of 1–60 cm/sec measured at 30.25 $cm^2$ flow cross-section.

The effective inoculation component of one embodiment of the present invention comprises a ferrosilicon carrier and at least one active element. The ferrosilicon carrier is a non-active element which dissolves in molten iron without forming seed nuclei. The active element is an element, or combination of elements, which dissolve in molten iron and react with elements in the molten iron to form seed nuclei upon which graphite preferentially crystallizes.

The effective component of one embodiment of the inoculant pellet preferably comprises 40–99.5%, by weight, carrier and 0.5–60%, by weight active element. Particularly preferred carriers are prepared from ferrosilicon comprising non-reactive impurities. Ferrosilicon is available commercially from a variety of sources. Ferrosilicon is typically provided as 75% ferrosilicon which indicates, by nomenclature in the art, that the material comprises approximately 75%, by weight, silicon and 25%, by weight, iron. Ferrosilicon is widely available as 50% ferrosilicon which indicates that the material comprises approximately 50%, by weight, silicon and 50%, by weight, iron. For the purposes of the present invention the binder includes all non-inoculating elements. It is most preferred that the carrier comprise at least about 30%, by weight ferrosilicon. It is preferable to add a binder to the effective components prior to forming a pellet. The binder, such as sodium silicate, is well known in the art to assist in pellitization of a powder.

The active inoculant elements preferably include at least one inoculating agent chosen from the group consisting of cerium, strontium, zirconium, calcium, manganese, barium, bismuth, magnesium, titanium, aluminum, silicon and lanthanum and alloys, particularly iron alloys, of these inoculating agents. Particularly preferred inoculating agents include at least one element chosen from the group consisting of strontium, aluminum, barium, zirconium and calcium. The inoculant preferably comprises about 0.5–60%, by weight inoculating agent. More preferably, the inoculant comprises about 0.5–40%, by weight, active inoculating agent. Most preferably, the inoculant comprises about 1–20%, by weight, active inoculating agent. Effective inoculation is described in U.S. patent application Nos. 10/043,644 filed Jan. 10, 2002 and 60/398,268 filed Jul. 24, 2002 which are included herein by reference thereto.

In one embodiment the inoculant tablet contains concentrated amounts of sulfide and oxide forming elements. The tablet preferably contains enough inoculating elements to effectively inoculate molten iron as the metal flows through the gating system during mold filling. The concentrated levels of inoculating elements gives an improved microstructure and chill reduction and dissolves rapidly without the use of auxiliary binders or energy consuming sintering.

The silicon levels in one embodiment of the tablet are preferably maintained at above 15% so as to provide exothermicity or a positive heat of solution and to assist other slower dissolving additions so as to improve the dissolution rate of the inoculant. Various levels of oxy-sulfide forming elements, may be added to the base alloy blend to enhance properties for specific applications.

In one embodiment the inoculant tablet has a specific gravity in the range of about 2.2 to about 2.5 grams/cc. The tablet preferably has a high solubility in cast iron with temperatures as low as 2250° F. The blend of ingredients used for tablet fabrication, but without the iron powder, can also be used in the granular form and have provided similar property improvement.

It is most preferred that the pellets be prepared from powders with a particle size of less than 1 mm and having a particular internal particle size distribution defined in the following way: passing to 1 mm: 100%; fraction between 50$\mu$ and 250$\mu$: 30% to 60%, and preferentially 40% to 50%; fraction below 50$\mu$: less than 25% and preferentially less than 20%.

A powder of this type agglomerates easily which makes it possible to operate with lower proportions of binding agent. Thus with sodium silicate, which is a well-known binding agent, doses of 0.3 $cm^3$ for 100 g of powder to 3 $cm^3$ for 100 g of powder are sufficient according to the pressures employed which may vary from 50 to 500 Mpa. Since the mechanical performance of the pellet is easily acquired, the pressure and binding agent percentage parameters may be used to control the dissolution speed of the pellet and not its mechanical performance.

The preparation of powder with this particle size distribution is preferably prepared by a dosing of size fractions prepared in isolation.

The dissolution rate of the inoculant is defined as the amount of inoculating agent introduced as a function of time. The analysis of certain inoculants is difficult therefore the dissolution rate is based on the analysis of a determinant element, either an inoculant or marker. The weight ratio of the determinant element to other inoculating agents is assumed to be the same in the cast iron as the weight ratio in the original pellet. For the purposes of the present invention zirconium is used as an inoculating determinate element. Therefore, the total inoculant in the cast iron is determined as the amount of zirconium plus other inoculants in the iron. For example, if an inoculant has 1 part zirconium, by weight, to 1 part calcium, by weight, and the amount of zirconium in the iron is 20 ppm then the amount of calcium will also be 20 ppm for a total inoculant of 40 ppm. The grams of zirconium plus calcium, or a total amount of 40 ppm, divided by the pour time is the inoculant dissolution rate.

An inoculant dissolution rate of at least approximately 0.02 g/sec. is necessary to have sufficient inoculation for approach velocities of 1–60 cm/sec. Below 0.02 g/sec. an insufficient inoculation rate is observed, particularly early in the pour, to insure minimum or no chill and to substantially eliminate the formation of iron carbide. Alternatively, the approach velocity must be lowered to a level which is impractical with an inoculant dissolution rate below approximately 0.02 g/sec. More preferably, the inoculant dissolution rate is no less than 0.03 g/sec. An inoculant dissolution rate of no more than approximately 0.32 g/sec. is required to insure that the rate of dissolution is sufficiently slow to insure that pellet remains throughout the entire pour at approach velocities of 1–60 cm/sec. Above approximately 0.32 g/sec. the pellet may dissolve prematurely thereby failing to inoculate the late portions of the pour. Alternatively, the approach velocity must be increased to a level which is impractical. More preferably, the inoculant dissolution rate is no more than approximately 0.25 g/sec. Most preferably, the inoculant dissolution rate is no more than approximately 0.20 g/sec.

The present invention illustrates that a ferrosilicon based inoculant can be prepared which, when prepared to a narrow range of dissolution rates, can be utilized as an inoculant pellet and the resulting cast iron has a low level of chill. Furthermore, the proper dissolution rate allows for superior inoculation with minimal inoculating agent. This substantially decreases the cost of inoculation and increases the predictability. Yet another advantage offered by the teachings herein is the ability to determine the proper amount of inoculant pellet to achieve a proper level of inoculation.

A dissolution rate of approximately 0.02 to approximately 0.32 g/sec. allows for the same pellet to by used at approach velocities of 1–60 cm/sec. without fade or under inoculation in any portion of the pour. More preferably, the dissolution rate is approximately 0.02 to approximately 0.32 g/sec. at approach velocities of approximately 1 to approximately 40 cm/sec. Even more preferably, approach velocities of 10 to 30 cm/sec. can be utilized and most preferably an approach velocity of 15–25 cm/sec. can be utilized with the preferred pellet dissolution rate of 0.05 to 0.25 g/sec. A particularly preferred pellet dissolution rate is 0.05 to 0.15 g/sec.

In a particularly preferred embodiment the dissolution rate of the pellet is determined at an approach velocity of 15 cm/sec. measured at a cross-sectional area of 30.25 $cm^2$. At an approach velocity of 15 cm/sec. the pellet preferably has a dissolution rate of at least approximately 0.05 g/sec. to no more than approximately 0.3 g/sec. More preferably, measured at an approach velocity of 15 cm/sec. the pellet has a preferred dissolution rate of at least approximately 0.05 g/sec. to no more than approximately 0.20 g/sec.

Approach velocity is a practical measure, well known in the industry, to indicate the volume of metal flowing to, and through, a filter. As would be apparent to one of ordinary skill in the art the approach velocity is determined at a fixed cross-sectional flow area. For the purposes of the present invention all approach velocities are calculated at a cross-sectional area of 30.25 $cm^2$ unless otherwise stated. It would be readily apparent to one of ordinary skill in the art that different cross-sectional areas would generate different approach velocities, however, the approach velocity could be easily compared to those cited herein by simple conversion as known in the art.

The dissolution rate of the pellet is controlled by composition and packing density. As the packing density increases the dissolution rate decreases. For the purposes of the present invention a ferrosilicon binder compressed to achieve a density of approximately 2.3 g/cc to approximately 2.6 g/cc is suitable to obtain the dissolution range required for the invention. Such a result can be obtained by adjusting the density of a pellet which can be obtained between 60% and 80% of the true density of the inoculant alloy the pellet is made of, depending on the pressure used for agglomerating which can vary from 50 to 500 MPa. Filter inoculant packages according to the invention, may be sized for the treatment of molten iron flow rates between 1 and 10 kg/s.

The form of the inoculant agent in one embodiment can be either a very dense pellet or a mixture of the same elements packed in a pellet with binders and the like. The range of chemistries available using this approach are much broader and allows the incorporation of concentrated levels of the critical elements needed for the inoculation process compared to traditional inoculating alloys which are produced by a smelting and casting process.

In one embodiment of inoculant tablets, the product is produced on a high pressure press utilizing iron powder as the primary 'carrier' and densification agent. The iron powder provides improved specific gravity and heat transfer for improved alloy dissolution. The iron powder provides a source of 'mechanical particle interlocking' that assists in the consolidation of the alloy ingredients into a tablet which possesses outstanding green handling properties. Use of iron as the "carrier" agent essentially eliminates the need for ferrosilicon based inoculating alloys.

In one embodiment the inoculating pellet comprises at least one element chosen from the group consisting of silicon, calcium, sulfur, magnesium and aluminum.

In one embodiment an inoculating pellet is made with varying blends of oxy-sulfide forming elements blended to form a mixture consisting essentially of 15–49% silicon, 7 to 22% calcium, 3 to 10% sulfur, 2 to 4% oxygen, 2.5 to 7.5% magnesium and 0.50 to 5.0% aluminum, the balance being iron and incidental impurities.

A preferred form of one embodiment of the inoculating insert or tablet consists of essentially about 15% silicon, 7.0% calcium, 3.0% sulfur, 4.5% aluminum, 2.0% oxygen, 5.0% magnesium, the balance being iron and incidental impurities. The preferred granulated inoculant consists of 49% silicon, 22% calcium, 2.7% magnesium, 2.8% sulfur, 2.8% oxygen, 1.5% rare earths, and 3.5% aluminum.

The pellet, either spheriodization or inoculation, is preferably secured to the filter by pressing the pellet into the well of the strainer. The pellet is preferably secured by friction fit between the lugs and the pellet. The pellet can be further secured to the surface by a suitable adhesive.

The invention has been described with particular emphasis on the preferred embodiments. It would be realized from the teachings herein that other embodiments, alterations, and configurations could be employed without departing from the scope of the invention which is more specifically set forth in the claims which are appended hereto.

What is claimed is:

1. A strainer for molten metal comprising:

a well; and a multiplicity of passages wherein each said passage comprises:

a first cavity;

a second cavity with a smaller equivalent diameter than said first cavity; and a neck between said first cavity and said second cavity further comprising an inoculant pellet received in said well wherein said well further comprises at least two lugs and said pellet is between said lugs.

2. The strainer of claim 1 wherein said well comprises a floor and said floor comprises at least one depression.

3. The strainer of claim 2 wherein said depression comprises glue.

4. The strainer of claim 1 wherein said well comprises a floor and said floor comprises a shelf.

5. The strainer of claim 4 wherein said second cavity has an equivalent diameter which is at least 10% smaller than said equivalent diameter of said first cavity.

6. The strainer of claim 5 wherein said second cavity has an equivalent diameter which is at least 20% smaller than said equivalent diameter of said first cavity.

7. The strainer of claim 5 wherein said second cavity has an equivalent diameter which is no more than 75% smaller than said equivalent diameter of said first cavity.

8. The strainer of claim 1 wherein said neck is at an angle, relative to a face of said larger cavity, of more than about 90° to no more than about 160°.

9. The strainer of claim 8 wherein said angle is at least about 110° to no more than about 150°.

10. The strainer of claim 1 wherein said first cavity has a depth of at least about 0.1 inches to no more than about 1 inch.

11. The strainer of claim 10 wherein said first cavity has a depth of at least about 0.2 inches to no more than about 0.5 inches.

12. A process for treating metal comprising:

melting said metal;

passing said molten metal through a strainer of claim 1.

13. The process for treating metal of claim 12 further comprising an inoculant pellet in said well.

14. A treatment device for molten metal comprising:

a strainer comprising:

a well; and a multiplicity of progressively stepped down passages; and a pellet comprising an inoculant for said molten metal wherein said pellet is received in said well wherein said well further comprises at least two lugs and said pellet is between said lugs.

15. The treatment device of claim 14 wherein said well comprises a floor and said floor comprises at least one depression.

16. The treatment device of claim 15 wherein said depression comprises glue.

17. The treatment device of claim 14 wherein said well comprises a floor and said floor comprises a multiplicity of shelves.

18. The treatment device of claim 14 wherein at least one passage of said passages comprises a first cavity; a second cavity with a smaller equivalent diameter than said first cavity; and a neck between said first cavity and said second cavity.

19. The treatment device of claim 18 wherein said second cavity has an equivalent diameter which is at least 10% smaller than said equivalent diameter of said first cavity.

20. The treatment device of claim 19 wherein said second cavity has an equivalent diameter which is at least 20% smaller than an equivalent diameter of said first cavity.

21. The treatment device of claim 19 wherein said second cavity has an equivalent diameter which is no more than 75% smaller than said equivalent diameter of said first cavity.

22. The treatment device of claim 17 wherein said neck is at an angle, relative to a face of said larger cavity, of at least about 90° to no more than about 160°.

23. The treatment device of claim 22 wherein said angle is at least about 110° to no more than about 150°.

24. The treatment device of claim 22 wherein said first cavity has a depth of at least about 0.1 inches to no more than about 1 inch.

25. The treatment device of claim 24 wherein said first cavity has a depth of at least about 0.2 inches to no more than about 0.5 inches.

26. The treatment device of claim 14 wherein said pellet is cylindrical.

27. The treatment device of claim 14 wherein said progressively stepped down passages each comprise at least two to no more than twenty step-downs.

28. A strainer for molten metal comprising:

a multiplicity of passages;

a well wherein said well comprises:

a floor;

a multiplicity of well passages through said floor; and a multiplicity of shelves on said floor; and at least two lugs extending into said well.

29. The strainer of claim 28 further comprising a pellet received in said well wherein said pellet is between said lugs and on said shelves.

30. The strainer of claim 28 wherein said passages comprise:

a first cavity;

a second cavity with a smaller diameter than said first cavity; and a neck between said first cavity and said second cavity.

31. A strainer for molten metal comprising:

a multiplicity of passages;

a well wherein said well comprises:

a floor;

a multiplicity of well passages through said floor; and at least two lugs extending into said well.

* * * * *